United States Patent [19]

Yuge et al.

[11] Patent Number: 4,572,102

[45] Date of Patent: Feb. 25, 1986

[54] METHOD OF CONTROLLING REPLENISHMENT OF TONERS

[75] Inventors: Shizuo Yuge, Toyokawa; Tateki Oka, Toyhashi; Susumu Sakakibara, Toyohashi; Naoki Toyoshi, Toyohashi, all of Japan

[73] Assignee: Minolta Camera Kabushiki Kaisha, Osaka, Japan

[21] Appl. No.: 586,762

[22] Filed: Mar. 6, 1984

[30] Foreign Application Priority Data

Mar. 17, 1983 [JP] Japan ..... 58-45575

[51] Int. Cl.[4] ..... G03G 15/00

[52] U.S. Cl. ..... 118/689; 118/691; 355/14 D

[58] Field of Search ..... 118/688, 689, 691; 355/3 DD, 14 D

[56] References Cited

U.S. PATENT DOCUMENTS 3,876,106 4/1975 Powell et al. ..... 118/691
4,370,053 1/1983 Hirayama et al. ..... 118/689
4,417,544 11/1983 Nishimura ..... 118/688

FOREIGN PATENT DOCUMENTS 5349438 10/1976 Japan .

*Primary Examiner*—John L. Goodrow
*Attorney, Agent, or Firm*—Wenderoth, Lind & Ponack

[57] ABSTRACT

A toner replenishment control method for a developing material including two kinds of toners triboelectrically chargeable to polarities opposite to each other, which includes the steps of causing the respective toners contained in the developing material to separately adhere to each of first and second surface areas of a detecting member having predetermined potentials, obtaining first and second detecting signals substantially proportional to amounts of the respective toners which have adhered to the first and second surface areas, the first and second detected signals being set to become equal to each other when a mixing ratio of the respective toners in the developing material is set at a standard mixing ratio, relatively comparing the first and second detected signals, and in the presence of a difference therebetween, replenishing either one of the respective toners to the developing material for eliminating the difference.

8 Claims, 5 Drawing Figures

METHOD OF CONTROLLING REPLENISHMENT OF TONERS

BACKGROUND OF THE INVENTION

The present invention generally relates to an electrographic process and more particularly, to a method of controlling replenishment of toners of a developing material accommodated in a developing material tank of an electrostatic latent image developing device for use, for example, in an electrographic copying apparatus and the like.

Commonly, in the development of electrostatic latent images, it has been known that developed images of an extremely high quality may be obtained if a developing material containing two kinds of toners which can be triboelectrically charged to polarities opposite to each other is employed. Moreover, by employing such a developing material as referred to above, it becomes possible to readily change over between a regular development (positive-positive development) and a reversal development (negative-negative development), and also to effect a two-color development. However, in order to effect a stable development by the use of the developing material as described above, it is necessary to properly maintain the toner concentration of the developing material accommodated in a developing material tank of a developing device, and more specifically, the mixing ratio of respective toners contained in the developing material.

In connection with the above, for properly controlling the mixing ratio of the respecitve toners as described above, it is preliminarily required to accurately detect the concentration (mixing ratio) of the respective toners in the developing material accommodated within the developing material tank of the developing device, and subsequently, to replenish the developing material tank with a fresh toner until the concentration (mixing ratio) of the respective toners to be detected based on the result of the above detection reaches a proper reference or standard value.

Conventionally, for the toner concentration detecting method related to the so-called dual-component or two-component magnetic developing material composed of a mixture of an electrically insulative toner and a magnetic carrier, there have been known various detecting methods for measuring the magnetic variation, capacity variation or variation of electrical resistance values of the developing material arising from variation in the toner concentration, through utilization of differences in the physical properties between said toner and carrier. However, in the detecting method as described above, since variations in the physical properties of the developing material on the whole due to the variation of the toner concentration are measured, it is not possible to accurately detect the concentration (mixing ratio) of the respective toners in the developing material containing two kinds of toners resembling each other in physical properties, so that there is a consequent difficulty in effecting the control for properly maintaining the mixing ratio of the respective toners.

SUMMARY OF THE INVENTION

Accordingly, an essential object of the present invention is to provide a method of controlling replenishment of toners, which is capable of properly maintaining at all times the mixing ratio of respective toners in a developing material containing at least two kinds of toners.

Another important object of the present invention is to provide a method of controlling replenishment of toners as described above, which is simple in its steps and efficient in operation, and can be readily introduced into developing devices of this type.

In accomplishing these and other objects, according to one preferred embodiment of the present invention, there is provided a method of controlling replenishment of toners to a developing material including two kinds of toners triboelectrically chargeable to polarities opposite to each other. The toner replenishment control method includes the steps of causing the respective toners contained in the developing material to separately adhere to each of first and second surface areas having predetermined potentials of a detecting member, obtaining first and second detecting signals substantially proportional to the amounts of the respective toners which have adhered to the first and second surface areas, the first and second detected signals being set to become equal to each other when the mixing ratio of the respective toners in the developing material is at a standard mixing ratio, relatively comparing the first and second detected signals, and, in the presence of a difference therebetween, replenishing one or the other of said respective toners of said developing material so as to eliminate the difference.

By the steps according to the present invention as described above, an improved toner replenishment control method has been advantageously provided, with substantial elimination of the disadvantages inherent in the conventional methods of this kind.

BRIEF DESCRIPTION OF THE DRAWINGS

These and other objects and features of the present invention will become apparent from the following description of a preferred embodiment thereof given with reference to the accompanying drawings, in which.

DETAILED DESCRIPTION OF THE INVENTION

Figure 1:
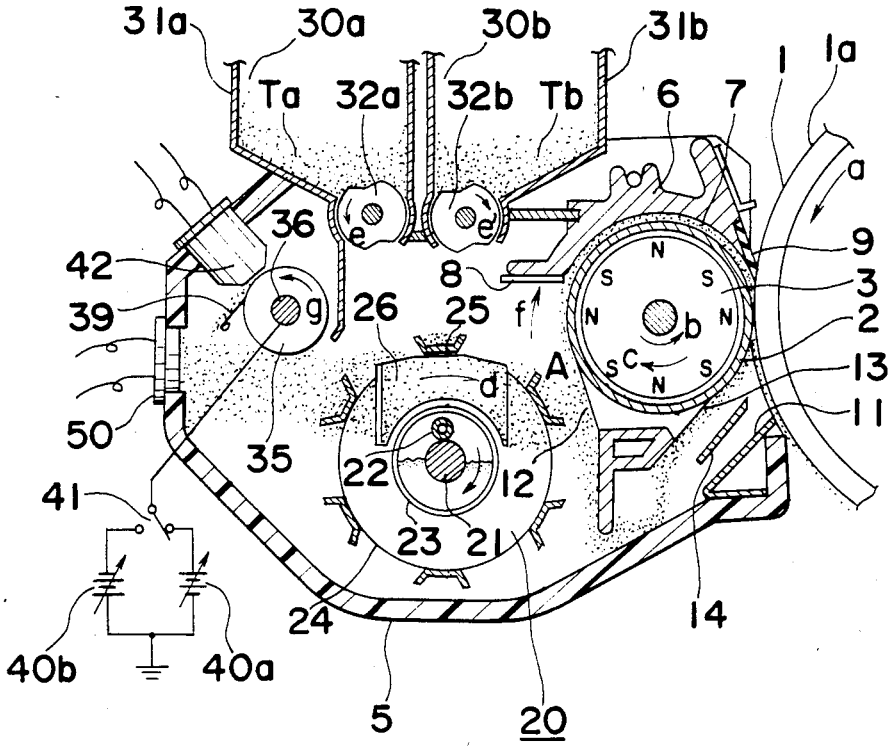
FIG. 1 is a schematic side sectional view of an electrostatic latent image developing device for carrying out the toner replenishment control method according to one preferred embodiment of the present invention.

Before the description of the present invention proceeds, it is to be noted that like parts are designated by like reference numerals throughout the accompanying drawings.

Referring now to the drawings, there is shown in FIG. 1 an electrostatic latent image developing device for carrying out the toner replenishment control method according to one preferred embodiment of the present invention. The developing device of FIG. 1 uses a magnetic brush developing system and is capable of effecting a regular and reversal development, and generally includes a casing 5, a developing sleeve 2 accommodated in the casing 5 to confront a photosensitive surface 1*a* of a photoreceptor drum 1, a magnet roller 3 rotatably accommodated within said developing sleeve 2, a developing material stirring device 20 also provided in the casing 5, and toner replenishing devices or toner dispensers 30*a* and 30*b* provided at the upper portion of the casing 5. The developing sleeve 1 made of a non-magnetic electrically conductive material, for example, stainless steel formed into a cylindrical configuration, is adapted to rotate in a direction indicated by the arrow "b" at a comparatively low speed confronting the photoreceptor drum 1 capable of rotating in the direction of arrow "a", and is provided with a variable developing bias applying means (not shown) for making it possible to effect the reversal development. Meanwhile, the magnet roller 3 alternately magnetized with N and S poles around its circumference is capable of being driven for rotation at a high speed in the direction of the arrow "c". More specifically, the developing material is subjected to moving forces in the direction of the arrow "b" through rotation of the developing sleeve 2, and also in the direction of the arrow "c" through rotation of the magnet roller 3, and is consequently is moved over the developing sleeve 2 in the direction of arrow "f" by the difference between the two moving forces.

The developing device of FIG. 1 surrounded by the casing 5 which functions as a developing material tank further includes a casing member 6 provided over the developing sleeve 2, with the inner peripheral surface of said casing member 6 being formed into an arcuate configuration concentric with the developing sleeve 2 so as to provide a passage 7 for the developing material therebetween. The casing member 6 has a bristle height regulating blade 8 fixed at the inlet end of the developing material passage 7, and an electrically insulative sealing member 9 secured at an outlet end of said passage 7.

On the other hand, under the developing sleeve 2, there are provided a toner spilling prevention plate 11 fixed to one corner portion of the casing 5, a cleaner 12 mounted to contact the surface of the developing sleeve 2 in a forward direction confronting the rotational direction thereof, a toner scraper 13 also mounted to contact the surface of the sleeve 2 in a reverse direction following the rotational direction thereof, and a developing material scattering prevention plate 14 provided above the toner spilling prevention plate 11.

The developing material stirring device 20 includes a transport tube 23 provided in the casing 5, and a rotary shaft 21 having a coil spring 22 spirally wound therearound and rotatably provided within the transport tube 23, while a bucket roller 24 coaxially mounted therearound has a plurality of troughs or buckets 25 of a generally U-shaped cross section disposed at equal intervals on the peripheral surface of the roller 24 and a stirring plate 26 is fixed to the reverse face of one bucket 25, and is adapted to be driven for rotation in the direction indicated by the arrow "d" so as to scoop up the developing material accommodated within the casing 5 by the buckets 25 for transportation thereof up to a position A located close to the developing sleeve 2.

The toner dispensers 30*a* and 30*b* provided, side by side, at the upper portion of the casing 5 respectively include toner tanks 31*a* and 31*b* having, at their bottom portions, openings which are communicated with the interior of the casing 5, and in which toner replenishing rollers 32*a* and 32*b* are rotatably provided so as to be independently driven for rotation in the directions indicated by arrows e and e'.

The developing material accommodated within the casing 5 is composed of a mixture of two kinds of black magnetic toners, i.e. a negatively charged insulative toner Ta and a positively charged insulative toner Tb, at a standard mixing ratio (weight ratio) of 1:1, and the negatively charger toner Ta to be replenished in this developing material is accommodated in the toner tank 31*a*, and the positively charged toner Tb is accommodated in the toner tank 31*b* respectively. The toners Ta and Tb are each supplied into the casing 5 by the rotation of the toner replenishing rollers 32*a* and 32*b*, and the replenishing amounts thereof may be controlled independently of each other as desired by controlling the rotating time of the replenishing rollers 32*a* and 32*b*.

Furthermore, at the left side upper portion within the casing 5 in FIG. 1, there is provided a detecting roller 35 made of an electrically conductive material such as aluminum or the like and driven for rotation in the direction indicated by the arrow "g". This roller 35 is connected to positive and negative DC bias power sources 40*a* and 40*b* through its shaft portion 36 made of an electrically conductive material and a brush 37 (FIG. 2), and the biasing polarities may be changed over by a switch 41. A scraper plate 39 is arranged to contact the peripheral surface of the detecting roller 35 in a forward direction confronting the rotational direction of said roller 35. Within the casing 5, when the positive polarity bias is applied, only the negatively charged toner Ta electrostatically adheres onto the surface of the roller 35, while on the contrary, when the negative polarity bias is impressed, only the positively charged toner Tb electrostatically adheres onto the surface of the roller 35 so as to be respectively moved in the direction of the arrow "g" for being scraped off by the scraper plate 39. The amounts of the respective toners Ta and Tb which adhere are substantially detected by detecting the reflection density on the surface of the roller 35 by a photo-sensor 42 provided at a position confronting the roller 35 in the casing 5. The photo-sensor 42 is composed of a light emitting element and light receiving elements so as to detect the amount of toner adhering by the alteration of detected values of the light receiving element according to the amount of the toner Ta or Tb adhering to the roller 35. More specifically, with references to FIG. 5 to be described in more detail later, in the case where the amounts of toner adhering are close to the amounts at which the reflection density of the adhering toners reaches the saturation density, no detection signal proportional to the amounts of toner adhering is available in the vicinity of the standard mixing ratio. In other words, in the case as described above, the variation of the amounts of toner adhering is difficult to detect by the reflection density variation. It is to be noted that the saturation density referred to above is the density at a region where the reflection density becomes difficult to change even when the amount of toner is varied. The detected values of both toners are relatively compared by a control circuit to be described in detail later, and thereafter, either the toner Ta or the toner Tb which has been detected as being relatively reduced, is selectively replenished so as to bring both of the detected values into agreement with each other. It is to be noted, however, that the other or counterpart toner Ta or Tb may be replenished by a small amount depending on necessity. In the above case, the voltage values of the bias power sources 40*a* and 40*b* are so controlled that the amounts of the toners Ta and Tb adhering to the roller 35 become equal when the mixing ratio thereof is at 1:1 i.e. at the standard value, according to the triboelectrical charging characteristics of the toners Ta and Tb.

In the case where the first and second detecting signals for the above detected values are directly proportional to the amounts of toners adhering, the difference between the detecting signals can be eliminated by replenishing the toner corresponding to the lower detecting signal, whereas if the first and second detecting signals are inversely proportional thereto, the toner corresponding to the higher detecting signal should be replenished for the elimination of the difference between the detected signals.

Figure 3:
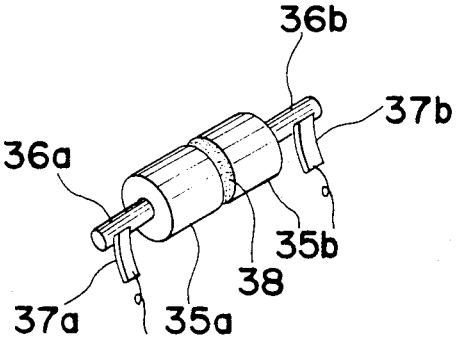

It should be noted here that the detecting roller 35 as described above may be prepared by providing an electrically insulative layer over the surface of an electrically conductive material, or that the roller 35 may by divided into two electrically independent rollers 35*a* and 35*b* by providing an electrically insulative layer 38 at an intermediate portion as shown in FIG. 3, in which case, the respective rollers 35*a* and 35*b* are connected to the bias power sources 40*a* and 40*b* through their shaft portions 36*a* and 36*b* and brushes 37*a* and 37*b*, eliminating the necessity for the switch 41.

Figure 2:
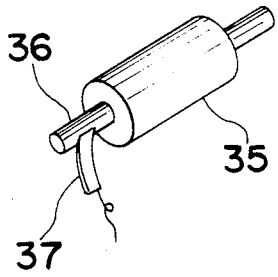
FIGS. 2 and 3 are perspective views of detecting rollers which may be employed in the developing device of FIG. 1.

Besides the employment of the detecting rollers in the forms as shown in FIGS. 2 and 3, it is possible to utilize the photoreceptor drum itself as a detecting member, and in this case, there may be employed a method as disclosed, for example, in U.S. Pat. No. 3,348,521, in which a permanent electrostatic latent image is provided on the surface of the photoreceptor drum for adhesion of the toner thereto. A first and a second surface areas having predetermined potentials for the detecting member are not fixed as in the employment of the detecting roller shown in FIG. 2. Meanwhile, for causing the respective surface areas to have predetermined potentials, there may be adopted a method in which the surface of the detecting member is adapted to be insulative, with said surface being charged.

On the other hand, at the left side portion of the casing 5 in FIG. 1, there is provided a developing material level sensor 50, which is intended to function to detect the absolute amount of the developing material accommodated within the casing 5 for maintaining constant the total amount of the developing material, and for this level sensor 50, pressure sensitive sensors utilizing ultra-sonic vibrations, magnetic sensors, reactance responsive elements, etc. may be specifically employed.

By the above arrangement, the developing material in the casing 5 is subjected to stirring and mixing through rotation of the bucket roller 24, and is transported by the buckets 25 of the roller 24 up to a position A where it is subjected to influence by the magnetic field of the magnet roller 3, and from the above position A, moved over the developing sleeve 2 in the direction of the arrow "f" in the form of magnetic brushes so as to rub against the surface 1*a* of the photoreceptor drum 1 for developing electrostatic latent images preliminarily formed on said surface 1*a* in a known manner. The developing material after being used for the development, is scraped off the developing sleeve 2 by the scraper 13.

In the above case, since either one of the toners Ta or Tb is consumed depending on whether the regular development or the reverse development is effected, it is necessary to replenish the toner thus consumed. For example, in the case where only the negatively charged toner Ta is consumed, the amount of toner adhering when the positive polarity bias is being impressed on the roller 35 is reduced, and the value detected by the photo-sensor 42 becomes smaller than the detected value for the toner Tb. Since the difference is to be approximately proportional to the mixing ratio of the toner Ta to Tb in the developing material, the replenishing roller 32*a* is rotated according to the difference between the two detected values for the replenishment of the toner Ta. Such replenishment is continued until the detected values by the photo-sensor 42 become equal to each other.

It should be noted here that the detecting signals are not limited to those proportional to the amounts of toner adhering as in the foregoing embodiment, and that either of the first and second signals may be one inversely proportional to the amount of toner adhering, and also that the detecting signals are not restricted to those as obtained by the photo-sensor.

Figure 4:
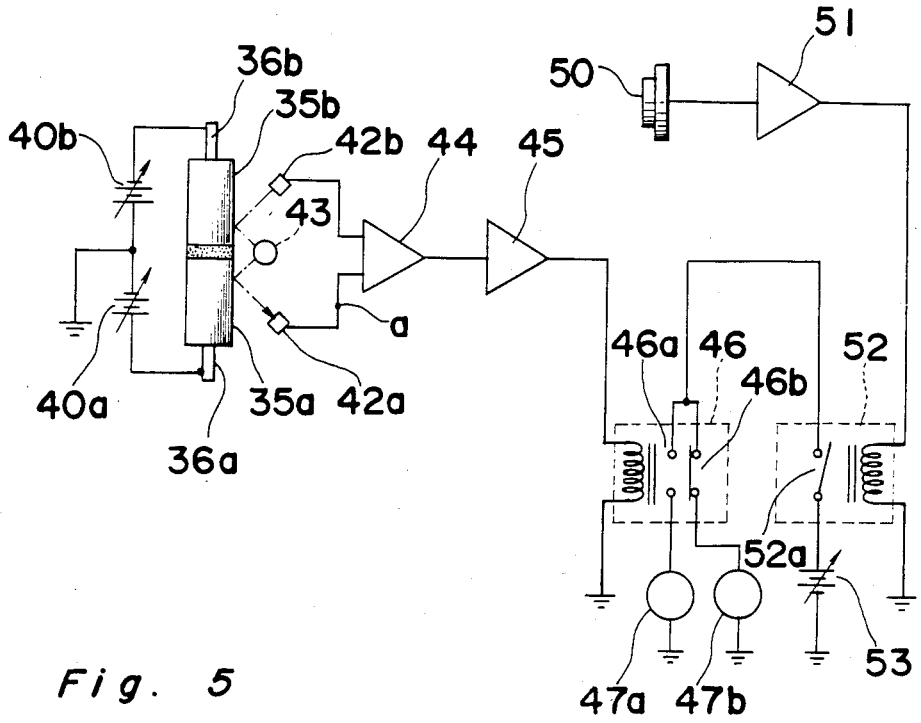
FIG. 4 is an electrical block diagram showing the construction of a toner replenishment control circuit employed for the arrangement of FIG. 1.

Referring also to FIG. 4, the construction of replenishment control circuit according to the present invention will be explained together with the functionings thereof. It is to be noted that, in the control circuit of FIG. 4, the detecting rollers 35*a* and 35*b* described earlier with reference to FIG. 3 are employed.

More specifically, in the circuit arrangement of FIG. 4, for the one light emitting element 43, there are provided two light receiving elements 42*a* and 42*b* positioned so as to respectively confront the rollers 35*a* and 35*b*, with the light receiving element 42*a* detecting the amount of the negatively charged toner Ta which has adhered to the roller 35*a* so as to produce an electrical output proportional to the amount of the adhesion, and the light receiving element 42*b* detecting the amount of the positively charged toner Tb which has adhered to the roller 35*b* for producing a similar electrical output. The respective electrical outputs are applied, as the detected values, to a comparator 44 connected to the light receiving elements 42*a* and 42*b*, and the output of the comparator 44 is applied to a replenishing motor driving control relay 46 through an amplifier 45. The normally open contact 46*a* of the relay 46 is connected to a motor 47*a* for driving the toner replenishing roller 32*a*, while the normally closed contact 46*b* thereof is connected to a motor 47*b* for driving the toner replenishing roller 32*b*.

On the other hand, the developing material level sensor 50 is arranged to produce an output only when the developing material within the casing 5 is below a predetermined level, and is connected to a constant capacity relay 52 through an amplifier 51. One contact of the normally open contacts 52*a* of the relay 52 is connected to the contacts 46*a* and 46*b* of the relay 46 described earlier, while the other contact thereof is connected to a motor driving power source 53.

The comparator 44 produces an output when the detected value at the side of the light receiving element 42*b* is higher than that at the side of the light receiving element 42*a*, i.e., only when the state is changed to one in which the ratio of the positively charged toner Tb in the mixture has been increased with respect to the predetermined desired mixing ratio as the developing material is consumed, and by the above output, the relay 46 is actuated to turn on the contact 46*a*. In the above case, since the decrease of the developing material is also detected by the level sensor 50 and the relay 52 is actuated to turn on the contacts 52*a*, conduction is established between the power source 53 and the motor 47*a* through the contacts 52*a* and 46*a*, and thus, the motor 47*a* is started to rotate the toner replenishing roller 32*a* for replenishment of the negatively charged toner Ta which is present in an amount too low for the proper the mixing ratio.

On the contrary, when the state is changed to show reduction of the ratio of the positively charged toner Tb, with the detected value at the side of the light receiving element 42*b* becoming equal to or lower than the detected value at the side of the light receiving element 42*a*, the output of the comparator 44 is suspended and the relay 46 is restored to turn on the normally closed contact 46*b*. By turning on of the contacts 52*a* through functioning of the relay 52 in a similar manner to that described earlier, conduction is established between the power source 53 and the motor 47*b* through the contacts 52*a* and 46*b*, and as the motor 47*b* is started, the toner replenishing roller 32*b* is rotated so as to supply the positively charged toner Tb which is present in an insufficient amount in the mixing ratio.

In either of the toner replenishments as described above, when the amount of the developing material within the casing 5 is increased and the output from the developing material level sensor 50 is suspended, with the returning of the relay 52 to turn off the normally open contacts 52*a*, the toner replenishing function is stopped.

More specifically, as explained based on the embodiment, in the case where the absolute amount of the developing material is larger than a predetermined amount (i.e., when this is detected by the level sensor 50 mentioned earlier), the replenishment of toner is not effected even when there is a difference between the first and second signals. Meanwhile, even if no difference is present between the two detecting signals, one of the toners is first replenished when the absolute amount of the developing material is below the predetermined amount (because the contact 46*b* of the relay 46 is a normally closed contact).

It is noted here that in the case where the detecting roller 35 as described earlier with reference to FIG. 2 is employed, the times of detecting the adhering amounts of the toners Ta and Tb are different, and thus, a circuit for storing one of the detected values is required so as to relatively compare the above stored detected value with the other detected value.

Meanwhile, particularly when two-color development and the like is to effected, a mixture of black toner and colored (red) toner is employed as a developing material. In the above case, since both of the toners have different light reflectances, detected values by the light receiving elements 42*a* and 42*b* are different from each other, even when the same amounts of toners have adhered to the rollers 35*a* and 35*b*, and thus, such detected values can not be applied to the comparator 44 as they are, since the colored toner tends to be excessively replenished even if the mixing ratio of the respective toners is at the predetermined desired mixing ratio.

Accordingly, in the case as described above, a correction circuit (i.e., an amplifier circuit or bias applying circuit) is inserted in one input side of the comparator 44, for example, at a point "a" in FIG. 4 so that the detected value applied is the same detected value to both inputs of the comparator 44 when the mixing ratio of the respective toners is at the predetermined desired mixing ratio. Alternatively, an arrangement may be provided in which, through variation of the bias potential values applied to the rollers 35*a* and 35*b* for the purpose of varying the amounts of toners adhering thereto, correction is effected to obtain the same detected values by causing the light receiving elements 42*a* and 42*b* to produce identical electrical outputs when the mixing ratio of the respective toners is at the predetermined desired mixing ratio. Furthermore, the surfaces of the rollers 35*a* and 35*b* can be subjected to a coloring treatment so as to preliminarily provide a difference in the reflecting density between said surfaces, so that the light receiving elements 42*a* and 42*b* are adapted to produce identical electrical outputs when the mixing ratio for the respective toners is at the predetermined desired mixing ratio. In short, setting may be so effected that in the case where the mixing ratio of the toners is at the predetermined desired mixing ratio, respective inputs (detected values) applied to the comparator 44 become equal to each other. It is to be noted that the above arrangement is not limited to two-color development.

Although the mixing ratio is set at 1:1 in the foregoing embodiment, such mixing ratio can be set at different desired values depending on the kinds of developing materials employed. For example, in a developing material composed of a combination of a magnetic toner (generally having a large specific gravity) and a non-magnetic toner (having a smaller specific gravity than the magnetic toner), it is necessary to set the ratio of the magnetic toner to be larger than the 1:1 mixing ratio.

Furthermore, for a colored toner, etc., if the surface of the roller 35*a* is a ground aluminum, it is difficult to distinguish between the ground aluminum and the adhering toner by the light reflection. In such a case, positive detection becomes possible if a proper colored paint of electrically insulative nature is coated on the surface of the roller 35*a*.

With respect to the kinds of developing materials, various other developing materials than those described so far may be used in the present invention, so long as they are developing materials containing at least two kinds of toners which may be triboelectrically charged to polarities opposite to each other, and the shades of such two kinds of toners may be selected as desired. For example, the developing material may be one composed of a mixture of two kinds of toners and a magnetic carrier, and the carrier may be triboelectrically chargeable or not triboelectrically chargeable with respect to the developing sleeve 2, but should preferably be positioned on the "triboelectric charge series" intermediate between the positively and negatively charged toners. Moreover, for correctly effecting control of the toner concentration, it is preferable further to make the amount and particle diameter of the magnetic carrier greater than those of the toner which is consumed.

With respect to the toner replenishment control circuit also, the control circuit described earlier with reference to FIG. 4 may be varied or modified in various ways within the scope of the invention.

It is to be noted here that in the foregoing embodiment, the purpose for providing the developing material level sensor 50 to effect the constant capacity replenishment, is to prevent not only the absolute amount of the developing material within the casing 5 from being rendered excessive, but also for preventing the density of the developed images from becoming insufficient, since the mixing ratio of the respective toners Ta and Tb tends to be varied to a large extent upon reduction of the absolute amount of the developing material.

It should also be noted that, in the respective toner tanks 31*a* and 31*b*, other kinds of toner may be preliminarily mixed in a small amount, for example, in such a manner as the positively charged toner Tb in the tank 31*a*, and the negatively charged toner Ta in the tank 31*b*.

More specifically, according to the present invention, it is so arranged that, after relative comparison of the detected values of the adhering amounts of the respective toners, the toner judged to be present in a lower amount in the mixing ratio is replenished, and since the detected values are relatively compared, proper toner replenishment may be effected, with a particular advantage that the replenishment is not affected by the characteristic variations of the respective toners.

Subsequently, the important feature of the toner replenishment control method according to the present invention will be described hereinbelow through explanation of fluctuations in the toner concentration upon variations of the toner characteristics.

It is to be noted here that variations in the developing characteristics of toners which produce the desired constant image density inevitably take place due to differences in the manufacturing lots, variations with time, etc.

Figure 5:
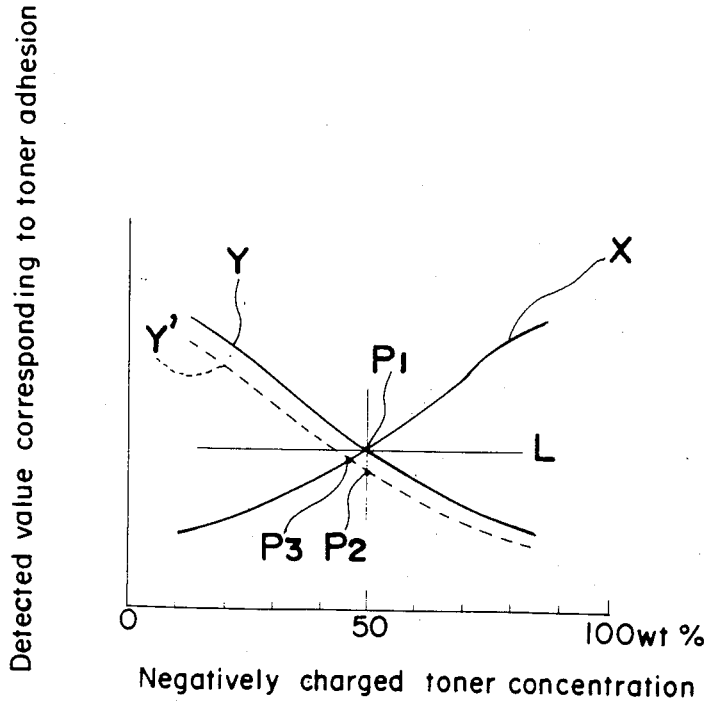
FIG. 5 is a graph showing variations of detected values corresponding to the toner concentration.

In the graph of FIG. 5 showing variations of the respective detected values according to the negatively charged toner concentration in the foregoing embodiment, the solid line X represents the detected value corresponding to the adhesion of a negatively charged desired developing characteristic toner, and the solid line Y represents the detected values corresponding to the adhesion of a positively charged desired developing characteristic toner, while the dotted line Y' represents the detected values corresponding to the adhesion of a positively charged toner having developing characteristics inferior to those of the positively charged desired developing characteristic toner. Due to the fact that the predetermined desired mixing ratio of the two desired developing characteristic toners have chosen to be 1:1, the toner concentration is maintained at an intersection P1 between the solid lines X and Y so far as the desired developing characteristic toners are employed. If a positively charged toner having inferior developing characteristics is employed, the amount of adhering is reduced more than the amount of the desired developing characteristic toner adhering. Therefore, even if the mixing ratio of the two toners is 1:1, there is produced a difference between the detected value P1 corresponding to the negatively charged toner adhesion and the detected value P2 corresponding to the positively charged toner adhesion. In the above case, when the toner replenishment is effected through comparison of the detected values for the two toners, the positively charged toner having the lower detected value is replenished, and consequently, the toner concentration is maintained at an intersection P3 of the solid line X and doted line Y', i.e., at the point where the detected values are equal to each other.

In the above state, even when the change-over between the normal development and the reversal development is effected, the amounts of both toners adhering with respect to the electrostatic latent image can actually be properly maintained to provide developed images with a generally constant density. In this respect, similar effects as above may be available even in two-color development.

It is to be noted that, in the case where the toners are replenished by comparing the detected value corresponding to the adhesion of one toner, for example, the positively charged toner, with the predetermined standard value (a value represented by L in FIG. 5), if the positively charged toner with the inferior developing characteristics as shown in FIG. 5 is employed, said detected value is reduced to the point P2 even when the mixing ratio is at 1:1. In this case, the positively charged toner is replenished until its the amount adhering reaches the standard value L, thus resulting in the state where the positively charged toner is excessively replenished, and, for example, if the change-over between the normal development and the reversal development is effected, a large difference is undesirably produced between the developed image densities for both.

As is clear from the foregoing description, since the present invention is so arranged that, the respective toners are caused to separately adhere to the members each having a predetermined potential and the amounts adhering are detected for relative comparison of the respective detected values so as to replenish the respective toners based on the result of the above comparison, the detected values are to be relatively compared, whereby the mixing ratio of the respective toners in the developing material can be properly maintained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of controlling replenishment of toners in a developing material including two kinds of toners triboelectrically chargeable to polarities opposite to each other, said toner replenishment control method comprising the steps of causing the respective toners contained in said developing material to separately adhere to each of first and second surface areas of a detecting member having predetermined potentials, obtaining first and second detecting signals substantially proportional to amounts of the respective toners which have adhered to said first and second surface areas, said first and second detected signals being initially set to become equal to each other when the mixing ratio of respective toners having the desired developing characteristics in a developing material is at a predetermined desired mixing ratio, directly comparing said first and second detected signals, and, when there is a difference therebetween, replenishing the one of said respective toners which will eliminate said difference.

2. A method as claimed in claim 1, wherein said first and second detected signals are directly proportional to the amounts of the respective toners adhering to said detecting member, whereby when there is a difference between said detected signals, the toner corresponding to the lower detected signal is replenished so as to eliminate said difference.

3. A method as claimed in claim 1, wherein said first and second detected signals are inversely proportional to the amounts of the respective toners adhering to said detecting member, whereby when there is a difference between said detected signals, the toner corresponding to the higher detected signal is replenished so as to eliminate said difference.

4. A method as claimed in claim 1, wherein said first and second detected signals are obtained by a detecting means including photo-sensors for measuring the reflection density of the toners which have adhered to said first and second surface areas.

5. A method as claimed in claim 4, wherein the amounts of the respective toners adhering to said first and second surface areas are sufficiently small as compared with amounts by which the reflection density of the toners which have adhered reach saturation density.

6. A method of controlling replenishment of toners in a developing material including two kinds of toners triboelectrically chargeable to polarities opposite each other and present in a developing material tank of a developing device for effecting development of electrostatic latent images by the employment of the developing material, said toner replenishment control method comprising the steps of causing the respective toners contained in said developing material to separately adhere to each of first and second surface areas of a detecting member having predtermined potentials, obtaining first and second detecting signals substantially proportional to amounts of the respective toners which have adhered to said first and second surface areas, said first and second detected signals being initially set to become equal to each other when the mixing ratio of respective toners having the desired developing characteristics in a developing material is at a predetermined desired mixing ratio, directly comparing said first and second detected signals, and replenishing the one of said respective toners which will eliminate any difference between the first and second detected signals.

7. A method as claimed in claim 6, wherein the replenishment of the one of said respective toners for the elimination of the difference between said first and second detected signals comprises replenishing only when the amount of the developing material in the developing material tank has been reduced to less than a predetermined amount.

8. A method as claimed in claim 7, wherein, when the amount of the developing material in the developing material tank is less than the predetermined amount, replenishing the one of said respective toners until the amount of said developing material reaches said predetermined amount, even when no difference is present in the result of the comparison between said first and second detected signals.

* * * * *